US006078022A

United States Patent [19]

Dulaney et al.

[11] Patent Number: 6,078,022

[45] Date of Patent: Jun. 20, 2000

[54] LASER PEENING HOLLOW CORE GAS TURBINE ENGINE BLADES

[75] Inventors: Jeffrey L. Dulaney, Dublin; Allan H. Clauer, Worthington, both of Ohio

[73] Assignee: LSP Technologies, Inc., Dublin, Ohio

[21] Appl. No.: 09/000,776

[22] Filed: Dec. 30, 1997

[51] Int. Cl.[7] ..... B23K 26/00

[52] U.S. Cl. ..... 219/121.85; 148/525; 148/565; 148/903; 219/121.71

[58] Field of Search ..... 219/121.85, 121.71; 148/525, 565, 903

[56] References Cited

U.S. PATENT DOCUMENTS 4,401,477 8/1983 Clauer et al. ..... 148/525

5,131,957 7/1992 Epstein et al. ..... 148/565

*Primary Examiner*—Deborah Jones
*Assistant Examiner*—Robert R. Koehler
*Attorney, Agent, or Firm*—Randall J. Knuth

[57] ABSTRACT

A hollow workpiece includes an outside surface through which a port opens to the hollow interior, and a laser peened area on the surface of the workpiece. The laser peened area is created on the surface while the hollow interior is at least partially filled with a substance other than air. A method of laser peening a hollow core gas turbine engine blade includes the steps of providing a hollow core gas turbine engine blade, filling the hollow core with a substance other than air, and then, laser peening the hollow core gas turbine engine blade.

23 Claims, 4 Drawing Sheets

LASER PEENING HOLLOW CORE GAS TURBINE ENGINE BLADES

BACKGROUND OF THE INVENTION

1. Field of the Invention

The present invention relates to the use of coherent energy pulses, as from high power pulsed lasers, in the shock processing of solid materials, and, more particularly, to methods and for improving properties of hollow core gas turbine engine blades by providing shock waves therein where the laser beam impacts the engine blade when the hollow core is filled with a substance or member. The invention is especially useful for enhancing or creating desired physical properties such as hardness, strength, and fatigue strength.

2. Description of the Related Art

Known methods for shock processing of solid materials, particularly laser shock processing solid materials, typically use coherent energy as from a laser oriented perpendicular to the workpiece.

Laser shock processing techniques and equipment can be found in the U.S. Pat. No. 5,131,957 to Epstein.

Known laser shock processing systems tend to form a relatively small, in cross sectional area, laser beam impacting on the surface of the workpiece. This has been accomplished, since to sufficiently work a surface of the workpiece, sufficient laser energy must be applied over a particular area. The smaller the area with the same amount of energy leads to a greater energy per unit area application. The more energy per unit area applied, the deeper the residual compressive stresses are applied to the workpiece.

In a number of gas turbine engine blades, particularly those in the high temperature sections of the gas turbine engine, there are hollow core blades that include air intakes in the blade attachment, or root, connected into a hollow space within the blade airfoil portion.

During two-sided split beam laser peening operations the airfoil section would collapse for some types of gas turbine blade geometries, particularly geometries where there is a thin cross section with a hollow space disposed therein.

SUMMARY OF THE INVENTION

The present invention provides a method of laser shock processing that can be used in a production environment to apply laser shock processing treatment to hollow core gas turbine engine blades and other hollow workpieces once thought not applicable for laser peening treatment.

The present invention in one form, includes use of a substance filled into the hollow core of the workpiece. Alternatively, a member may be inserted into the hollow cavity within the workpiece or blade, into intimate contact with the interior surfaces thereof. Different substances and different types of member are shown, some dependent on the shape of the hollow core or cavity.

The term hollow as used in this application is that of a cavity or substantially enclosed empty space within the workpiece or gas turbine engine blade.

The invention, in another form thereof, comprises a gas turbine engine blade, having an airfoil member with a hollow interior. The airfoil member includes an outside surface having at least a portion of the hollow interior beneath the outside surface. A laser peened region is created on the outside surface above the hollow interior.

In another form of the invention, the outside surface includes at least two ports to the hollow interior, the laser peened region is at least partially located on the outside surface between the ports. In different embodiments of the invention, the outside surface may be the suction side, pressure side, leading edge, or trailing edge of the airfoil member.

The invention, in yet another form thereof, comprises a method of laser peening a hollow core gas turbine engine blade, including the steps of providing a hollow core gas turbine engine blade, filling the hollow core with a substance other than air, and then laser peening the hollow core gas turbine engine blade. In a preferred form of the invention, the filling step utilizes a substance having a similar acoustic impedance to that of the hollow core gas turbine engine blade.

In different embodiments of the present invention, a variety of different substances may be utilized to fill the hollow core. Particular fluids, water, powders, molten metals, salts, lathers, lead, mercury, and other solid or liquid materials, or combinations thereof, may be utilized to fill the hollow.

The invention, in another form thereof, includes an additional step of heating the hollow core gas turbine engine blade to melt or vaporize the substance disposed within the hollow volume.

The invention, in still another form thereof, comprises inserting an inflatable bladder at least partially into the hollow core of a gas turbine engine blade, prior to the laser peening of the blade. Additional pressurizing methods may include supplying a pressurized liquid into the hollow core, or a combination of any of the prior filling steps.

In another form of the invention, a pressurizing step is created by simultaneously causing a pressure wave to move into the interior of the gas turbine engine blade, which prevents blade collapse during the laser peening step.

In yet another form of the invention, laser peening a hollow core gas turbine engine blade comprises providing the hollow core gas turbine engine blade and filling the hollow core with a member. The member is then placed in contact with an interior surface of the gas turbine engine blade. The laser peening operation then takes place on an exterior location adjacent to the contact point of the member. The member filling step may utilize a hydraulic cylinder or rope wire as the contact member. Additionally, the filling step may utilize an expanding material shape that may expand once inserted into contact with the interior surface of the gas turbine engine blade, thereby acting as a momentum trap. This shape would have a thickness similar to or greater than the length of the pressure pulse generated by laser shock peening. It would have a lateral size equal to or greater than that of the laser spot impacted on the outside surface of the airfoil. Also, the filling step may utilize an inflatable bladder as the member.

An advantage of the present invention is that workpieces with a hollow core, such as hollow core gas turbine engine blades may now be effectively laser shock processed without the airfoil warping or collapsing.

Another advantage is that such workpieces and gas turbine engine blades may be laser shock processed in a production environment.

Yet another advantage is that such gas turbine engine blades having ports along a surface or edge may now be effectively laser shock peened between or around the ports.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

The method of the present invention includes the steps of providing a hollow core gas turbine engine blade, filling the hollow core with a substance other than air, and then laser peening the hollow core gas turbine engine blade. Additionally, the invention in another form comprises the workpiece or aircraft gas turbine engine blade formed by the method.

Figure 1:
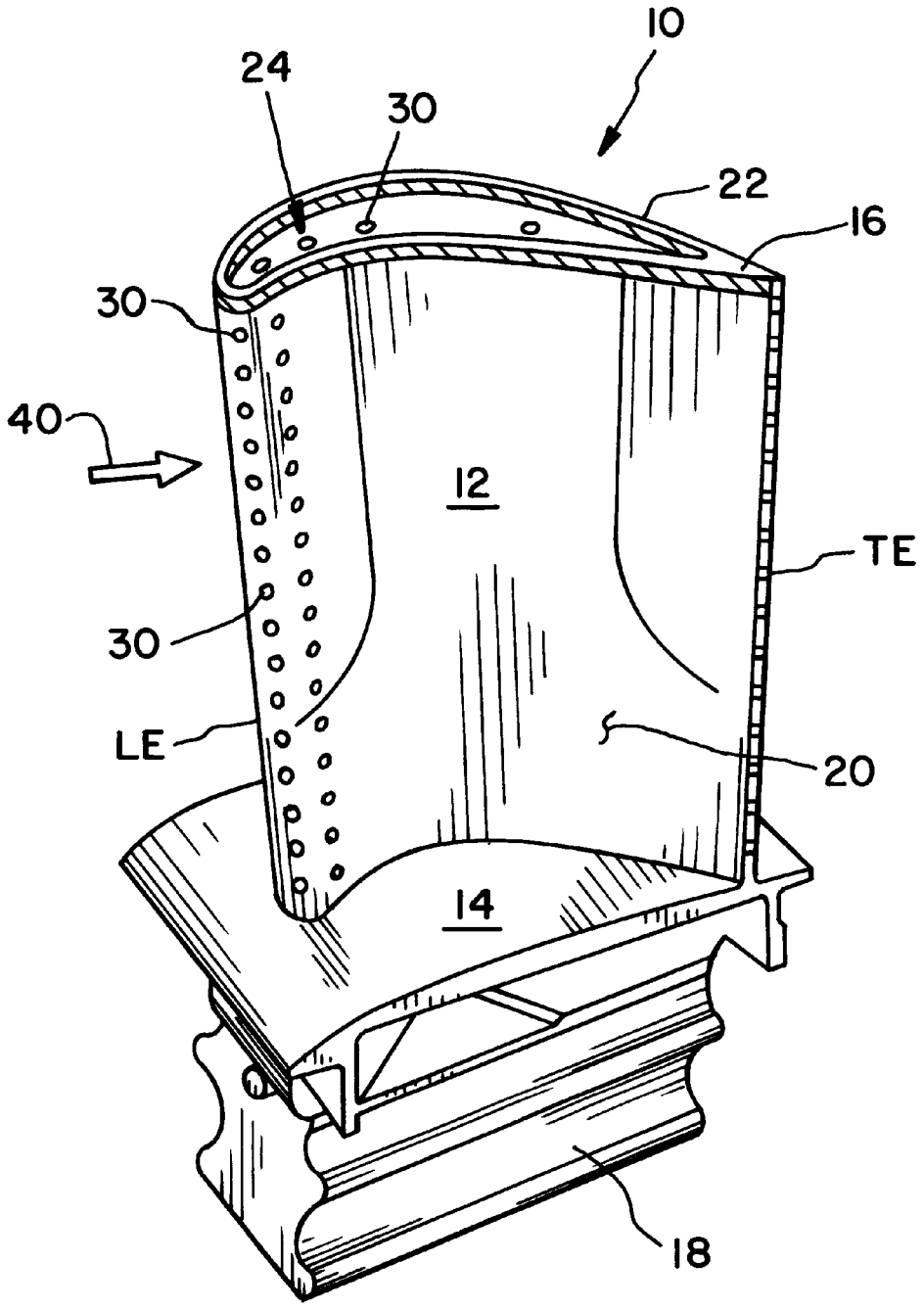
FIG. 1 is a perspective illustrative view of an aircraft gas turbine engine blade in accordance with the present invention.

Referring now to the drawings and particularly to FIG. 1, there is shown a workpiece, such as an aircraft gas turbine engine blade 10. Such blade 10 includes an airfoil 12, extending radially outward from a blade platform 14 to a blade tip 16. The engine blade 10 includes a root section 18 for attachment to a rotor. Alternately, some blades are forged or cast integrally with a rotor, i.e., a blisk or integrated rotor and disk assembly. Airfoil 12 includes a leading edge LE and a trailing edge TE. The airfoil 12 extends in a chordwise direction between the leading edge LE and trailing edge TE. A pressure side 20 of the airfoil 12, faces in the general direction of rotation, while a suction side 22 is on the other side of the airfoil. Turbine 12 includes a hollow core open cavity 24 located between suction side 22 and pressure side 20. Cavity 24 is bounded by an interior surface 28 (FIG. 2)

Figure 2:
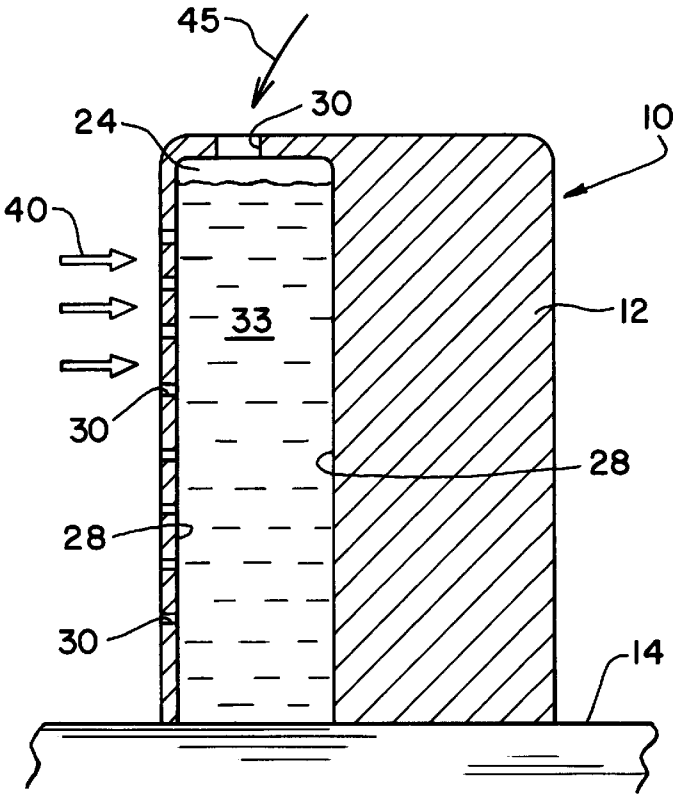
FIG. 2 is an exaggerated, sectional diagrammatic view of one embodiment of the present invention, in which a substance is filled into the hollow core of a gas turbine engine blade.

As shown in FIGS. 1 and 2, a plurality of ports 30 are shown located through airfoil 12 into communication with the hollow or cavity 24. Although in FIG. 1, ports 30 are shown on pressure surface 20 and leading edge LE, ports 30 may be located in other locations, surfaces and edges of airfoil 12.

The arrows 40 indicates the orientation of a potential laser peening operation against blade 10. Of course, other orientations and positions of laser peening may be applied to blade 10. FIG. 2. shows a sectional diagrammatic view of the hollow 24 located in airfoil 12.

In the present invention, the prior problems of warpage and crushing of the hollow airfoil 12 when laser shock processed or peened are eliminated. In general terms, the excess energy associated with the passage of the pressure pulse that forms the desired compressive residual stresses is dissipated, transferred or absorbed. If sufficient energy is not removed from the pressure pulse, collapse or distortion of the blade wall will occur, creating unacceptable tensile residual stresses and out-of-tolerance surface contours in the airfoil. The action of the present invention reduces the likelihood of the creation undesired tensile residual stresses and distortion in the workpiece, in this case a blade 10.

By filling the hollow 24 of airfoil 12 before laser peening, an improved part and with improved properties results. As shown in FIG. 2., a substance is filled into hollow 24. Substances useful for this purpose are particular fluids, water, powders, molten metals or salts, lathers, lead, mercury, and other solid or liquid materials, or combinations thereof. If molten, the substance properties may be enhanced if cooled to a solid state after filling and before laser peening. Of particular importance is that the substance have a higher acoustic impedance than air. The acoustic impedance of a material is defined as $Z=P_0C_0$ where $P_0$ is the initial density of the material and $C_0$ is the sonic wave velocity. When the acoustic impedances of the blade and fill materials are equal, the pressure pulse passes into the fill material with no reflected waves from the boundary between the two materials, as if both were the same material.

When a pressure pulse passes through the airfoil material from the surface and then impacts on the interior surface between the air foil wall and the fill material, three different types of reactions can occur. On the one hand, if the acoustic impedance of the fill material is less than that of the blade material, a tensile stress wave is reflected from the boundary and contributes to collapse of the airfoil wall. On the other hand, if the acoustic impedance of the fill material is higher than that of the airfoil material, a compression wave is reflected from the boundary and contributes to a bulging of the outside surface. When both impedances are equal there is no reflection and the materials bounding is transparent to the pressure pulse. Therefore, the closer the acoustic impedance of the fill material is to the airfoil material, the smaller are the undesirable effects of laser shock peening, and the greater the desirable effects.

FIG. 2 more particularly shows the preferred embodiment, that of a liquid substance 33 such as molten lead or other metal poured (thin arrow 45) into hollow 24 prior to the laser peening operation. After the laser peening operation has ceased, the substance is removed from hollow 24, such as by heating airfoil 12 to vaporize or liquidize the substance used. The laser peening operation with the new invention may take place on the surface between ports 30 along with at other locations on the surface.

Figure 3:
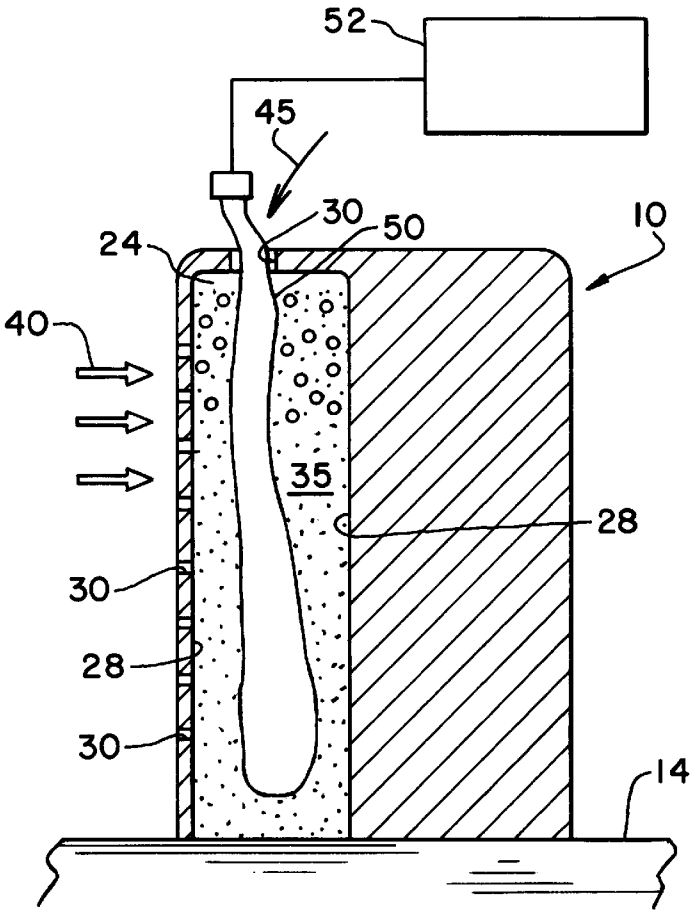
FIG. 3 is an exaggerated, sectional diagrammatic view of one embodiment of the present invention, in which a powder substance is filled into the hollow core of a gas turbine engine blade with the addition of a pressurization means.

FIG. 3 shows hollow 24 filled with a powder or powder-liquid mixture substance 35 and a pressurization means 50. Pressurization means 50 includes an inflatable bladder connected to a source of pressurized fluid 52, such as a pump. Prior to the laser peening operation, hollow 24 is filled with a substance such as a powder 35 and the inflatable bladder. When pressurized, the inflatable bladder packs powder 35 within hollow 24 behind surface 28, thereby raising the effective acoustic impedance behind surface 28, within hollow 24, for increased effectiveness.

Figure 4:
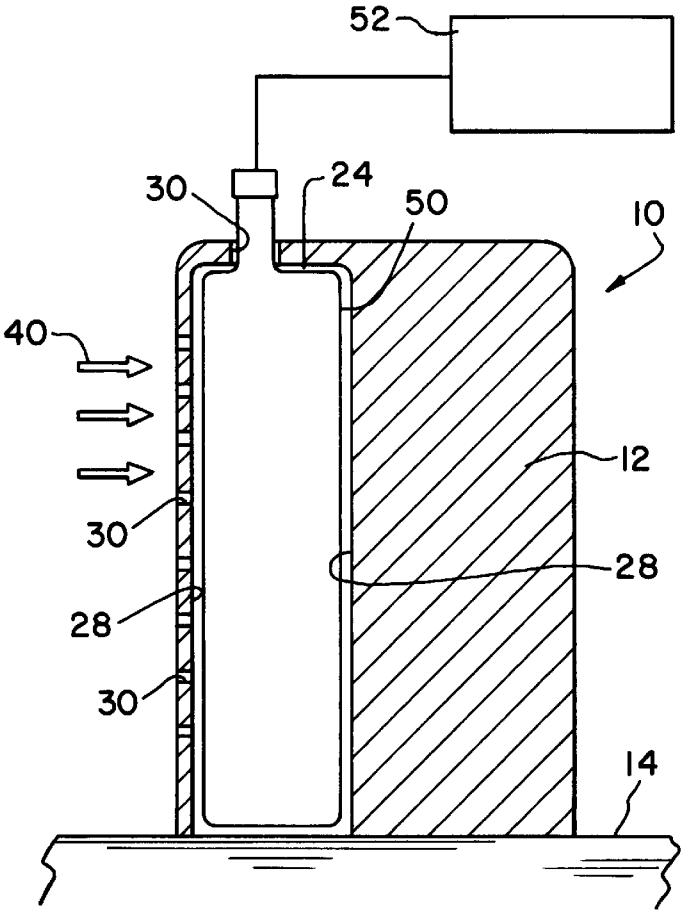
FIG. 4 is an exaggerated, sectional diagrammatic view of another embodiment of the present invention, in which an inflatable bladder means is inflated in the hollow core of a gas turbine engine blade.

FIG. 4 shows another embodiment of the present invention in which a similar pressurization means 50 is inserted into hollow 24 without a powder or other substance. In this case the inflatable bladder, made of rubber or other material is pressurized and inflated prior to laser peening airfoil 12.

Figure 5:
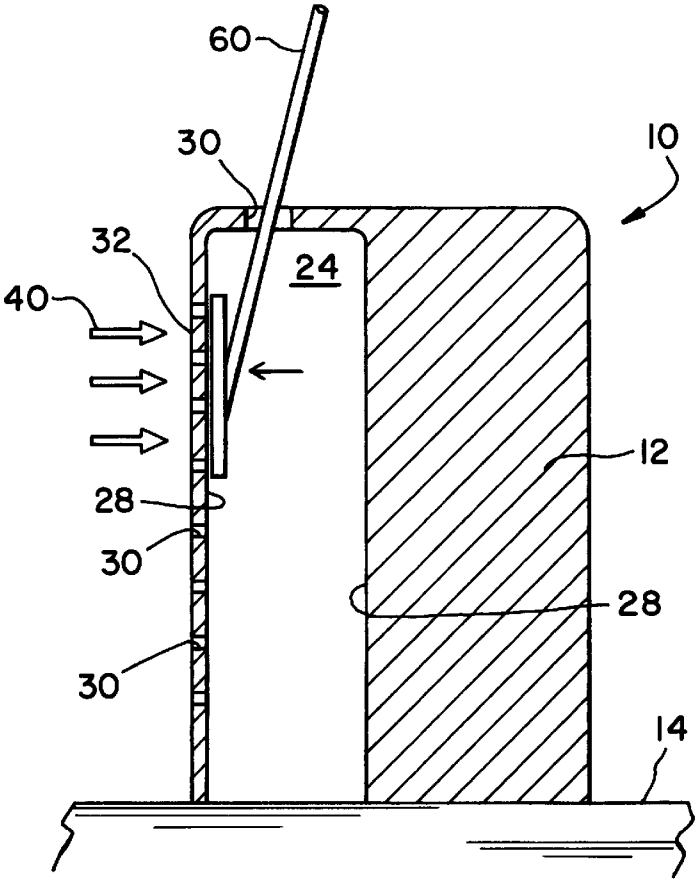
FIG. 5 is an exaggerated, sectional diagrammatic view of one embodiment of the present invention, in which a member is filled into the hollow core of a gas turbine engine blade such as a pressing member or dolly.

In another embodiment of the invention, as shown in FIG. 5, a member 60, is inserted through a port 30 into hollow 24. Member 60 is located and biased against an interior surface 28 of airfoil 12 opposite the location of the surface area to be laser peened. To increase the effectiveness of the contact and enhance momentum transfer away from exterior surface 32 of airfoil 12, member 60 may be biased against interior surface 28 such as by a spring or other biasing mechanisms.

Figure 6:
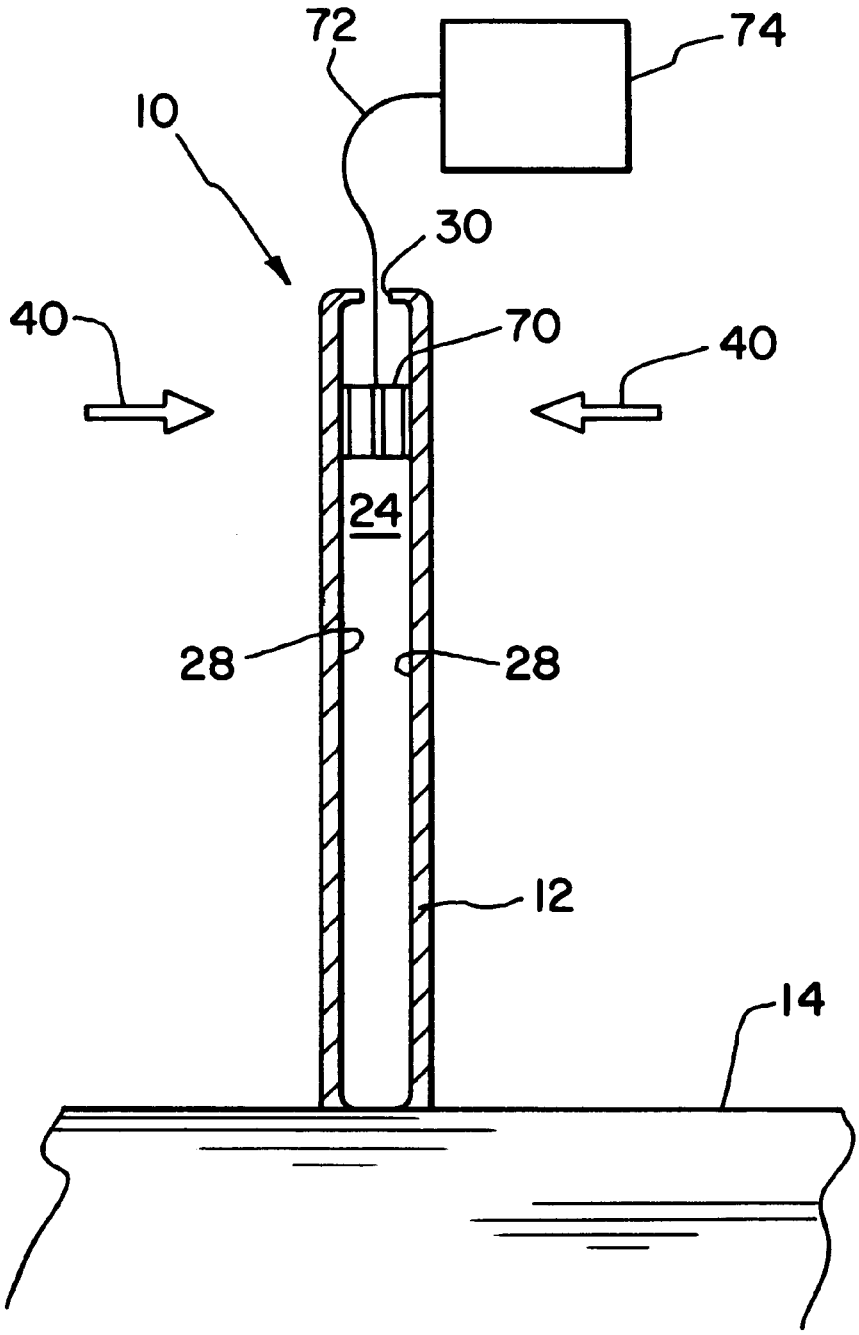
FIG. 6 is an exaggerated, alternate sectional diagrammatic view of one embodiment of the present invention, in which a hydraulic cylinder pressurizing member is fitted into the hollow core of a gas turbine engine blade.

FIG. 6, showing a different sectional view of an airfoil 12 in which split beam laser peening is applied to airfoil 12. Laser peening operations operate substantially simultaneously on opposite sides of airfoil 12. A member, such as a hydraulic cylinder 70 is inserted through a port 30 into hollow 24. Prior to laser peening of airfoil 12, hydraulic cylinder 70, connected to a source of hydraulic pressure 74 by supply line 72, is pressurized. By pressurizing the cylinder sufficient to hold the ends of the cylinder firmly against the interior surfaces 28 substantially below or opposite to the areas of exterior surface 32 to be laser peened, the previous effects of warping or crushing of the thin airfoil section is reduced and preferably eliminated. The pressure must be kept low enough not to bulge the airfoil wall. The benefits are obtained from the passage of the pressure wave into the material of the cylinder, not from the pressure. The other embodiments of the invention may also be utilized with split beam laser peening operations.

The fill material may also consist of a thread- or wire-like substance. This material would be threaded into the hollow 24 until packed tightly against the surface 28. This embodiment could also be combined with a bladder to compress the thread or wire against the surface 28.

In another embodiment, the filling thread, wire, powder, or liquid can be modified once inside the hollow 24, to expand and thereby increase contact and against surface 28. This may be accomplished using various physical mechanisms such as differential thermal expansion, memory effects, liquid absorption, and phase transformations.

In addition, pressure pulses may be generated within hollow 24 to counteract the effects of the pressure pulse from the exterior surface upon reaching surface 28. These pressure pulses would be generated simultaneously with the exterior pressure pulses. One method to do this would be to introduce a pulsed laser beam into the hollow 24 through a means such as a fiber optic to produce a pressure pulse on surface 28 to counter balance the pressure pulse entering from the exterior surface. This would reduce or eliminate distortion and tensile residual stress in the airfoil wall.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of laser peening a hollow core gas turbine engine blade, the method comprising the steps of:

providing a hollow core gas turbine engine blade;

filling said hollow core with a substance other than air;

and then laser peening the hollow core gas turbine engine blade.

2. The laser peening method of claim 1 in which said filling step utilizes a substance having a similar acoustic impedance to that of the hollow core gas turbine engine blade.

3. The laser peening method of claim 1 in which said filling step utilizes a fluid as the filling substance.

4. The laser peening method of claim 1 in which said filling step utilizes a powder as the filling substance.

5. The laser peening method of claim 1 in which said filling step utilizes a molten metal as the filling substance.

6. The laser peening method of claim 1 in which said filling step utilizes a molten salt as the filling substance.

7. The laser peening method of claim 1 in which said filling step utilizes a solid metal as the filling substance.

8. The laser peening method of claim 7 in which said filling step utilizes lead as the filling substance.

9. The laser peening method of claim 1 in which said filling step utilizes mercury as the filling substance.

10. A method of laser peening a hollow core gas turbine engine blade, the method comprising the steps of:

providing a hollow core gas turbine engine blade;

filling said hollow core with a substance other than air;

laser peening the hollow core gas turbine engine blade; and heating the hollow core gas turbine engine blade.

11. The laser peening method of claim 1 in which said filling step utilizes a powder as the filling substance and additionally includes pressurizing the powder within the hollow core.

12. The laser peening method of claim 11 in which said pressurizing step comprises inserting an inflatable bladder at least partially into the hollow core.

13. The laser peening method of claim 11 in which said pressurizing step comprises supplying a pressurized liquid into the hollow core.

14. A method of laser peening a hollow core gas turbine engine blade, the method comprising the steps of:

providing a gas turbine engine blade having a hollow core;

pressurizing the hollow core; and then laser peening the hollow core gas turbine engine blade.

15. The laser peening method of claim 14 in which said pressurizing step utilizes pressurized water.

16. The laser peening method of claim 14 in which said pressurizing step is created by causing a pressure wave though the interior of gas turbine engine blade which prevents blade collapse during said laser peening step.

17. A method of laser peening a hollow core gas turbine engine blade, the method comprising the steps of:

providing a hollow core gas turbine engine blade;

filling the hollow core with a member;

placing the member in contact with an interior surface of the gas turbine engine blade; and then laser peening the hollow core gas turbine engine blade at an exterior location adjacent the contact point.

18. The laser peening method of claim 17 in which the filling step utilizes a hydraulic cylinder as the member.

19. The laser peening method of claim 17 in which the filling step utilizes a rope wire as the member.

20. The laser peening method of claim 17 in which the filling step utilizes an expanding wire shape that may expand once inserted to contact the interior surface of the gas turbine engine blade.

21. The laser peening method of claim 17 in which the filling step utilizes an inflatable bladder as the member.

22. The laser peening method of claim 17 in which said placing step includes expanding the member inserted into the hollow core by a physical mechanism.

23. A method of laser peening a hollow core gas turbine engine blade, the method comprising the steps of:

providing a hollow core gas turbine engine blade;

filling the hollow core with a member;

placing the member in contact with an interior surface of the gas turbine engine blade, wherein said placing step includes expanding the member inserted into the hollow core by a physical mechanism; and then laser peening the hollow core gas turbine engine blade at an exterior location adjacent the contact point;

wherein the member is powder and the physical mechanism is a phase transformation of the powder.

* * * * *